US007841951B1

(12) United States Patent
Schiltz

(10) Patent No.: US 7,841,951 B1
(45) Date of Patent: Nov. 30, 2010

(54) GOLF CLUB SUPPORT REQUIRING NO BENDING OR STOOPING AND METHOD OF MERCHANDISING

(76) Inventor: Terry W. Schiltz, 13875 Fish Hill Rd., South Wales, NY (US) 14139

( * ) Notice: Subject to any disclaimer, the term of this patent is extended or adjusted under 35 U.S.C. 154(b) by 164 days.

(21) Appl. No.: 12/342,526

(22) Filed: Dec. 23, 2008

Related U.S. Application Data

(60) Provisional application No. 61/016,475, filed on Dec. 23, 2007.

(51) Int. Cl.
*A63B 55/10* (2006.01)

(52) U.S. Cl. ..... 473/282

(58) Field of Classification Search ..... 473/282; 248/156, 530, 688
See application file for complete search history.

(56) References Cited

U.S. PATENT DOCUMENTS 3,441,239 A 4/1969 Frost
4,343,449 A * 8/1982 Osthus ..... 248/156
5,437,449 A 8/1995 Zink
5,730,404 A 3/1998 Evans et al.
6,346,051 B1 2/2002 Otsubo
6,383,088 B1 5/2002 Kershner

* cited by examiner

*Primary Examiner*—Stephen L. Blau
(74) *Attorney, Agent, or Firm*—Patricia M. Costanzo

(57) ABSTRACT

A golf club support device for use without requiring bending or stooping is provided. The support is molded as a seamless one-piece device having no removable or rotatable parts, is impervious to the elements, moisture, and ordinary cleaning products, and is sized to fit into a golf-tee container. The device includes golf shaft engagement member(s) and a foot-press platform for inserting its ground penetration portion into the ground. The foot-press platform and engagement members are positioned relative to each other for simultaneous use. The support may be hung from a golf-bag's towel holder or carried in the tee container. The device's geometric design provides desirable support stability and while the device is easily inserted into the ground, a wider mid-portion keeps the support from sinking below the ground surface and/or from toppling to one side. The support's low-cost and simple design provides for the device's use as a marketing tool.

14 Claims, 5 Drawing Sheets

GOLF CLUB SUPPORT REQUIRING NO BENDING OR STOOPING AND METHOD OF MERCHANDISING

CROSS-REFERENCE TO RELATED APPLICATIONS

This Application claims the benefit of Provisional Application No. 61/016,475 filed on Dec. 23, 2007.

STATEMENT REGARDING FEDERALLY SPONSORED RESEARCH OR DEVELOPMENT

Not Applicable

REFERENCE TO SEQUENCE LISTING, A TABLE OR A COMPUTER PROGRAM LISTING COMPACT DISK APPENDIX

Not Applicable

BACKGROUND

The present invention relates generally to supports for golf clubs and, more particularly, to a low-cost golf club support, approximating the size of a golf tee that provides for the secure, vertical support of nearly any desired golf club without a golfer having to bend or stoop to position the support/golf club combination in the ground or to retrieve it from the ground.

The background information discussed below is presented to better illustrate the novelty and usefulness of the present invention. This background information is not admitted prior art.

While playing golf, there often are times when a golfer lays a golf club on the ground, forgets that it is on the ground, and thus, loses club. This may happen when the golfer approaches a putting green with two clubs, i.e., one that may be used for chipping and another which is likely a putter. After chipping the ball onto the putting green, the golfer my lay the club used for chipping on the ground in order to use the putter. Even if the golfer does remember to retrieve the chipping club when leaving the putting green, the grip may become wet from moisture on the wet turf, which then ruins the golfer's grip on that club. Moreover, the grip may become stained from the turf soil or from the turf, itself. It is easy to see, therefore, that a need still exists for a device that is able to securely support a golf club in an orientation that will prevent the grip of the club from coming into contact with the ground and becoming soiled or wet while keeping the club in full view to prevent a golfer from leaving the golf club behind. Such a device would, ideally, be of size that is conveniently small for storage and transport and of low manufacturing cost. With these attributes, the device could also serve as an ideal venue for merchandizing and gift-giving, thus serving several purposes at the same time.

The inventor, noticed while playing golf, that the numerous attempts to provide for a golf club support device have one or more failings. One such attempt includes devices that consist of a ground penetrating part from which a contoured support surface extends so that it is elevated slightly above the ground to act as a club support. A major drawback, the inventor realized, is that these devices require a golfer to bend or to stoop in order to insert the device into the ground, so that once the device is in the ground, the golf club grip, or the shaft adjacent the grip, can be positioned on the contoured surface while the head of the golf club rests in contact with and on the ground. Gravity is supposed to retain the golf club as positioned on the device keeping the grip elevated above the ground. However, this method of temporary retention has proven to be less effective than desired by golfers. It is fairly common for the golf club to shift, such as from the weight of the head settling and causing slight rotation of the golf club, which causes the club to fall off of the device onto the ground during placement or removal. To recover the golf club from the support and to remove the tool from placement in the ground, the golfer must once again bend or stoop, which may cause considerable discomfort to golfers who have a difficult time performing any bending or stooping, let alone repetitive bending tasks. Additionally, this type of device does not position the golf club to be easily visible, and therefore does not reduce the tendency for the club to be overlooked during play and left behind when the player moves on.

Another attempt to provide for a golf club support is first attached to the grip end of the a golf club and is then inserted into the ground with the golf club generally vertically supported, but with the head of the golf club at the highest elevated position and the grip near the ground. This class of device is not acceptable to many golfers for several reasons. In the first place repetitive coupling and decoupling of the golf club support device to the grip tends to damage the grip and, thereby, shortens the life-time of the golf club. Additionally, while a club is in the support, the end of the grip of the golf club is in close proximity to the ground, and may often be touching the grass. In this position the grip will often have moisture transferred to it from the grass. Additionally, the part of the device that penetrates the ground in a more or less vertical position is formed to approximate a fork having two flat prongs. This configuration has a surface area greatly reduced than that of a solid square or rectangle, and thus the holding (in the ground) power is minimized. Moreover, the ground penetrating prongs are taught to be 2.5 inches in length, while the upper vertical portion is 4.5 inches. Thus, the ability of the support to maintain the club in a vertical position is minimized. Furthermore, the ground penetrating fork-like part extends down from one side of an approximately square shaped grip-support platform. Moreover, having the heavier club head end elevated with the lighter grip end near the ground, further minimizes the ability of the club support to maintain the club in a vertical position. Furthermore, this device is manufactured in individual parts which must be attached to each other before the device is ready for use. These parts can become loose, require replacement, and become lost. Some of the parts are metal which means that rust and corrosion are also a concern.

There are additional attempts, but these require even more parts such as springs, hinges, and screws and are more cumbersome.

As described, various attempts have been made to provide for golf club supports to support golf clubs while golfers are using an alternative club. These attempts have been less successful than desired. Accordingly, it may be appreciated by other's, as was recognized by the instant inventor, that there continues to be a need for a device of simple construction sized to fit into the golf tee's storage bag, made in a one-step process using low-cost materials without any moveable parts, may easily be attached and detached to and from a golf club without any potential for damage being inflicted upon the golf club and which may be easily and securely inserted into and supported in the ground to support a golf club in an approximately upright position with the grip of the golf club retained well above the ground and where the device can be used by golfers without the need for a user to bend or stoop either to insert or remove the support from the ground or from the club.

Moreover, what is needed is a golf club support device with all of the above desire features, plus being impervious to the effects of weather and dampness, and that is affordable to all.

SUMMARY

The present invention provides for a golf club support device of simple construction, sized to fit into the golf tee's storage bag, made in a one-step process using low-cost materials without any moveable parts, is easily and rapidly attached and detached to and from a golf club without any damage being inflicted upon the golf club, especially on the grip, and which may be easily and securely inserted into the ground to support a golf club in an approximately vertical position with the grip of the golf club supported well above the ground surface and where the device can be easily seen to prevent the club and support from being left behind when the golfer moves to the next hole. Importantly, the device attached to the golf club can be used by golfers without the need for a user to bend or stoop either to insert or remove the support from the ground or from the club. Not only do many golfers have a difficult time performing these repetitive bending or stooping tasks, as the age of golfers continues to increase, many players are physically incapable of bending or stooping in such a manner, especially those who have undergone hip and/or knee replacement. Regardless of their afflictions, these golfers wish to continue taking part in the game and the present invention helps them to do this. The material used to manufacture the support provides for the support being impervious to the effects of weather and dampness, as well as to most cleaning agents, and for it to be affordable to all.

The structure of an embodiment of the golf club support device according to the principles of the present invention comprises a foot-press platform that is maintained relatively horizontal to ground surface when the device is positioned for use in the ground, a ground penetrating portion that tapers to a point from the bottom of the platform providing for ease of ground penetration extends toward the ground from the bottom of the foot-press platform is. Extending from one side of the upper surface of the foot-press platform is, in the example provided, a tabular upper portion from which a first shaft-engagement clamp member and a second shaft-engagement clamp member extend outwardly from the side of the tabular upper portion that is opposite to the side from which the foot-press platform extends. The stake-like ground penetration portion extending from the bottom surface of the foot-press platform is in axial offset alignment from the tabular upper portion. The ground penetration portion has a longitudinal length that approximates the longitudinal length of the tabular upper portion. The foot contact surface of the foot-press platform is for application there-against of an insertion pressure to the golf club support device to force the ground penetration portion into the ground. The first and second shaft engagement members each securely engage an exposed shaft portion of the golf club providing for the long axis of the golf club to be maintained relatively vertical.

All of these benefits are presented by providing for:

a device, that comprises:

a shaft support approximating the height of a golf-tee, comprising:

an upper portion having a first and second side, and an optional aperture to hang the device from a golf cart's towel holder hook.

an intermediate flange portion extending from the first side at substantially a right-angle thereto, the flange portion having a foot-press upper surface and a lower surface, one or more clamps extending from the second side of the upper portion, the clamp spaced a distance relative to the intermediate portion, a spiked lower portion extending from the lower surface generally parallel to the upper portion. If desired, the shaft may be the shaft of a golf club.

Further the upper portion, the intermediate flange portion, the at least one clamp, and the spiked lower portion together comprise a seamless all-in-one structure that could be a molded structure wherein the at least one clamp is a resilient clamp.

The support requires no moveable parts, and requires that no clamp is spaced less than a distance equal to the length of a golf club head from the intermediate portion.

Whenever this small and affordable device is to be used as a merchandizing or advertising too, it will further comprises an area on the first side and/or the second side containing graphics.

Additionally, the invention may be describes as a golf club support, comprising:

a golf club support device sized to be stored and/or transported in a golf tee container, comprising:

an upper portion having a first and second side, an intermediate flange portion extending from the first side at substantially a right-angle thereto, the flange portion having a foot-press upper surface and a lower surface, at least one clamp extending from the second side of the upper portion, the clamp spaced a distance relative to the intermediate portion, a spiked lower portion extending from the lower surface generally parallel to the upper portion.

The golf club support may also be described as comprising:

a support device for supporting a golf club without requiring bending or stooping of the user, the support device molded as a seamless one-piece structure having no moving parts and sized to approximated the size of a golf tee, the structure comprising:

a lower portion, comprising:

a central flange portion, a stake-like portion, and an upper portion having a first side and a second side and an axis of elongation, the central flange portion extending at a substantially right-angle from the first side of the upper portion, the central flange portion having a foot-press platform upper surface that is maintained relatively horizontal to ground surface when the device is inserted in the ground and a lower surface.

the stake-like portion for ground penetration extending from the lower surface at substantially a right-angle thereto in axial offset alignment from the upper portion, the upper portion having at least a first shaft engagement member extending from the second side for securely engaging a shaft portion of a golf club providing for the long axis of the golf club to be supported relatively vertical when the device is inserted in the ground, the lower portion having a longitudinal length that approximates the longitudinal length of the upper portion, the upper portion comprising an area on the first side and/or the second side containing graphics.

The present invention resides not in any one of the separate features per se, but rather in the particular structure and particular dimensions, and the combinations of the features herein disclosed that provide for the advantages not achieved to date. There has thus been outlined, rather broadly, the more important attributes of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the inventive concept, upon which this disclosure is based, may readily be utilized as a basis for the design of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

So that the features and advantages of the present invention, as depicted above, may be more fully comprehended and appreciated, the invention will now be described, by way of an example, with reference to a specific embodiment thereof, which is illustrated in appended drawings wherein like reference characters indicate like parts throughout the several figures. It should be understood that these drawings only depict preferred embodiments of the present invention and are not therefore to be considered limiting in scope, thus, the invention will be described and explained with additional specificity and detail through the use of the accompanying drawings, in which.

DEFINITIONS

Figure 1:
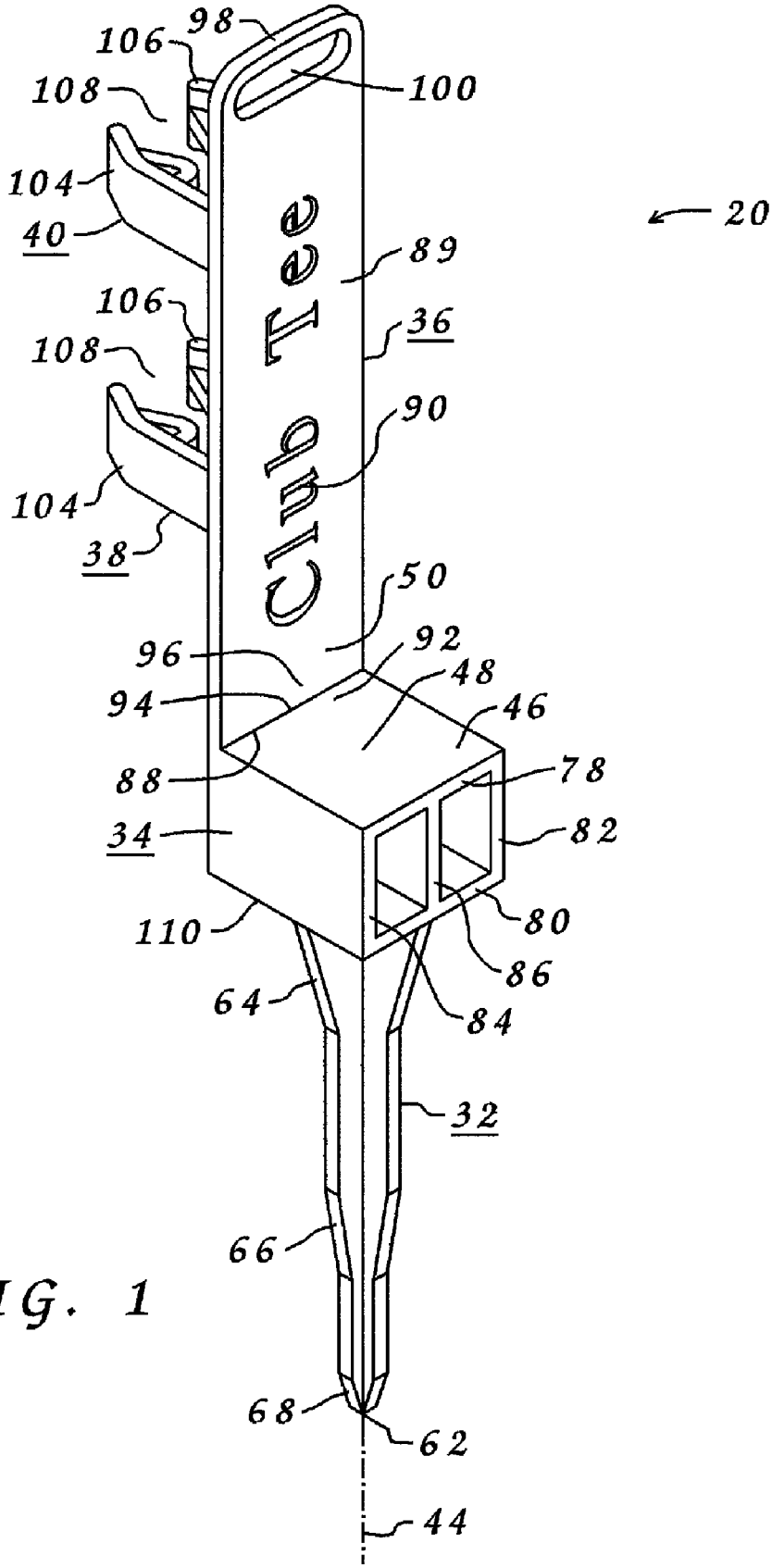
FIG. 1 is a perspective illustration of a golf club support device of the present invention.

Engagement means, as used herein, refers to any conventionally known structural arrangement of securely engaging an object, such as a clamp of the golf club support device described herein clamping onto a shaft portion of a golf club in proximity to a head portion of the golf club.

Golf club and the unique portions thereof, as used herein, refer to a work piece with which the present invention functions.

Graphics, as used herein, are visual presentations on some surface, such as a wall, canvas, computer screen, paper, or stone to brand, inform, illustrate, or entertain. Examples are photographs, drawing, Line art, graphs, diagrams, typography, numbers, symbols, geometric designs, maps, engineering drawings, or other images. Graphics often combine text, illustration, and color. Graphic design may consist of the deliberate selection, creation, or arrangement of typography alone, as in a brochure, flier, poster, web site, or book without any other element. Clarity or effective communication may be the objective, association with other cultural elements may be sought, or merely, the creation of a distinctive style. Graphics can be functional or artistic. The latter can be a recorded version, such as a photograph, or an interpretation by a scientist to highlight essential features, or an artist, in which case the distinction with imaginary graphics may become blurred.

Offset means, as used herein, refers to any conventionally known structural arrangement to provide for one designated axis to be significantly offset from another designated axis, such as, the axis of the upper portion of the support as described herein to be offset from the axis of penetration of the structural element penetrating the ground (the stake-like portion of the support).

Penetration means, as used herein, refers to any conventionally known structural arrangement of penetrating the ground with a structural element, such as a stake or the stake-like element named herein, to provide for resistance to lateral movement of the structural element.

It should be understood that the drawings are not necessarily to scale. In certain instances, details which are not necessary for an understanding of the present invention or which render other details difficult to perceive may have been omitted.

REFERENCE NUMERALS AND PARTS TO WHICH THEY REFER

20 Golf club support device (also referred to as attachment member).
22 Golf club.
24 Ground surface.
26 Head of golf club 22.
28 Exposed shaft of golf club 22.
30 Grip covered shaft part of golf club 22
32 Ground penetration portion of golf club support device 20.
34 Central flange portion of support device 20 providing for foot-press platform 46.
36 Tabular (upper) portion of golf club support device 20.
38 One golf club shaft engagement member of tabular upper portion 36 of golf club support device 20.
40 Another golf club shaft engagement member of tabular upper portion 36 of golf club support device 20.
44 Axial length and axis of penetration of ground penetration portion 32.
46 Foot-press platform of central portion 34 of golf club support device 20.
48 Center area of foot-press platform 46.
50 Foot abutment surface of tabular upper portion 36 of golf club support 20.
52 Coupling (second) surface opposing abutment surface 50.
54 One of four planar members intersecting ground penetration portion 32.
56 One of four planar members intersecting ground penetration portion 32.
58 One of four planar members intersecting ground penetration portion 32.
60 One of four planar members intersecting ground penetration portion 32.
62 Distal end of ground penetration portion 32.
64 Decreasing (in width) tapers of planar member 54, 56, 58, and 60.

66 Decreasing (in width) tapers of planar member 54, 56, 58, and 60.
68 Decreasing (in width) tapers of planar member 54, 56, 58, and 60.
78 Upper relatively horizontal panel of central flange portion 34 (upper surface).
80 Lower relatively horizontal panel of central flange portion 34 (lower surface).
82 First relative vertical side panel of central flange portion 34.
84 Second relative vertical side panel of central flange portion 34.
86 Center relative vertical panel of central flange portion 34.
88 Side of foot-press platform 46 of central flange portion 34 from which tabular portion 36 extends.
89 First side of upper portion 36.
90 Display symbol.
92 Width of foot-press platform 46.
94 Line of contact between central portion 34 and tabular upper portion 36.
96 Width of tabular upper portion 36.
98 Distal end of tabular upper portion 36.
100 Aperture of distal end 98 of tabular upper portion 36.
102 Axis of securement that first and second shaft engagement members 38 and 40 cooperate to define relative to exposed shaft portion 28 of golf club 22.
104 Flexible pressure clip type prongs on one side of first and second shaft engagement members 38 and 40.
106 Flexible pressure clip type prongs on another side of first and second shaft engagement members 38 and 40.
108 Passageway between flexible pressure clip type prongs 104 and 106.
110 Lowest extent and surface of central portion 34.
112 A position for support device 20 to be attached to shaft part 28 of golf club 22.
114 A position on shaft part 28 spaced from head portion 26 of golf club 22.

DETAILED DESCRIPTION

Referring now, with more particularity, to the drawings, it should be noted that the disclosed invention is disposed to embodiments in various sizes, shapes, and forms. For example, the number of golf club shank grips could be more or less than two, or their position or shape could be modified. The shape and surface area of the foot-press platform could vary widely. The shape of the ground penetration part could be changed as well as the length and width being increased or decreased. Therefore, the embodiment described herein is provided with the understanding that the present disclosure is intended as illustrative and is not intended to limit the invention to the embodiments described.

The inventor's desire to have a small, that is sized to approximate the size of a golf tee so that it may be transported and/or stored in the golf-bag's tee container, golf club support that can securely support a golf club shaft above the ground surface and keep the club easily visible without requiring a user to bend or stoop to insert or to retrieve the support and club is fulfilled by his invention comprising an economical to manufacture golf club support, sized to fit into a golf-tee storage compartment, molded in a one-step process as a seamless all-in-one-piece device, having a flanged ground insertion part that maintains a heavy golf club in an approximately vertical position to keep the club grip above the ground surface and to keep the club easily visible without requiring a user to bend or stoop to insert or to retrieve the support. Moreover, the device is easily and quickly attached and detached from the golf club of choice without presenting a potential for damage of the golf club. The material used to make the device provides for the device to be weather and element resistant.

Figure 2:
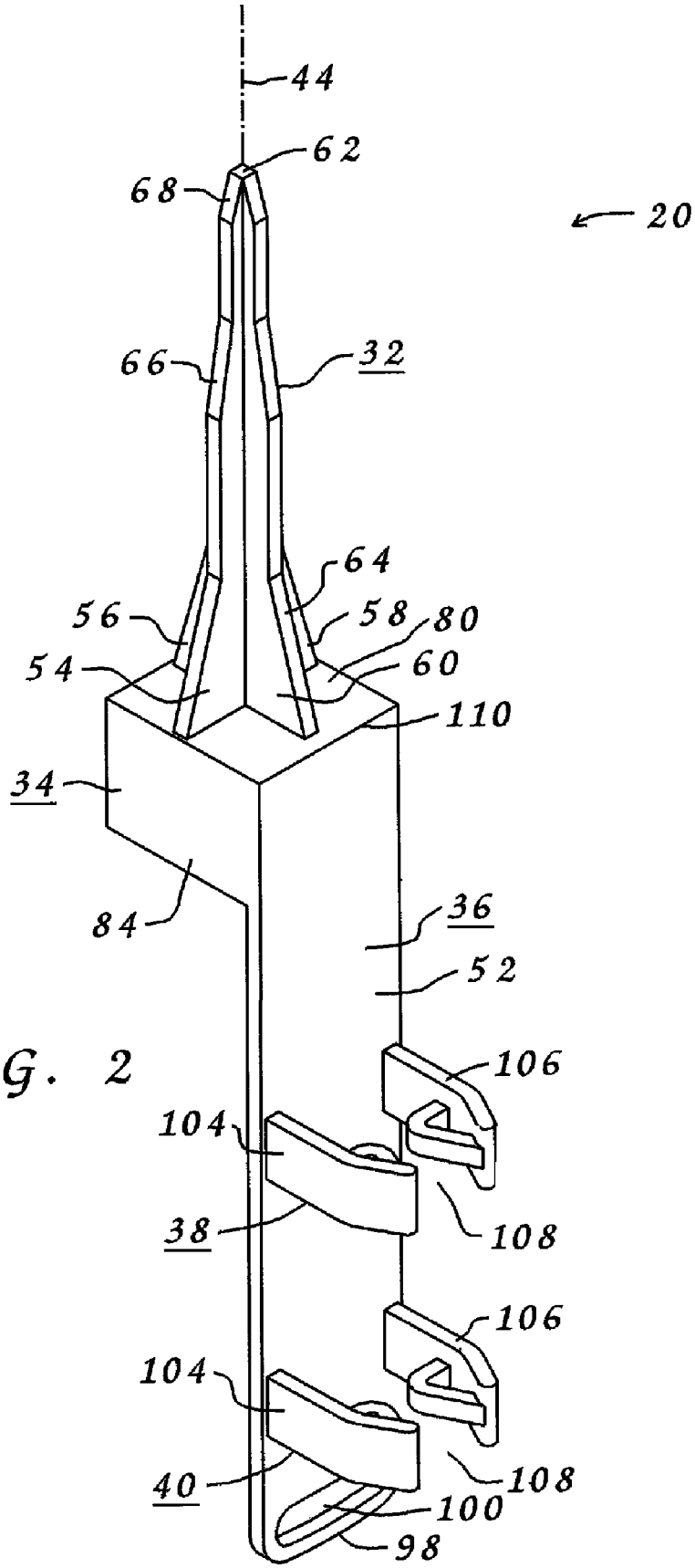
FIG. 2 is a perspective view of the golf club support device shown in FIG. 1 in an alternative orientation.

FIGS. 1 and 2 illustrate golf club support device 20 in opposing orientations. In this embodiment, golf club support device 20 is manufactured as one continuous piece by injection molding. When manufactured using this process the support is most likely made from a plastic or a material with similar properties that provides for the device to be impervious to the elements and to almost any type of cleaning composition or process. Making the device as a one-piece seamless structure also provides for the benefit of having no extra pieces to add to the device to be lost or broken and no moving or rotating parts that can become immovable with use. Golf club support device 20 comprises a seamless structure of three major structural portions: (1) central flange portion 34 including foot-press platform 46, (2) tabular (upper) portion 36 extending upwards from central portion 34 including first shaft engagement member 38 and second shaft engagement member 40, and (3) ground penetration (stake-like) portion 32, extending downwards from central flange portion 34, including foot-press platform 46. Central flange portion 34 may be a single planar member or, as illustrated in FIGS. 1 and 2, have a geometry that provides substantial strength and additional supporting strength and functionality to golf club support device 20. Central portion 34, in the embodiment illustrated, has an upper, relatively horizontal panel 78, a lower, relatively horizontal panel 80, a first relative vertical side panel 82, a second relative vertical side panel 84 and a center relative vertical panel 86.

Tabular upper portion 36, as depicted, preferably extends upwardly from top surface horizontal panel 78 and merges (as in having a seamless construction) with horizontal panel 78, lower relatively horizontal panel 80, first relative vertical side panel 82, second relative vertical side panel 84 and center relative vertical panel 86. This arrangement provides for an enhanced structural integrity of golf club support device 20. Thus, tabular upper portion 36 is in direct contact with edge 88 of foot-press platform 46 of central portion 34. Tabular upper portion 36 extends in a direction opposed to the extension direction of ground penetration portion 32 as it extends downwardly from surface 110 of tabular upper portion 36. It is to be understood that tabular upper portion 36 may have any desired structural and dimensional configuration, but the device most securely hold a golf club in a vertical position when upper portion 36 is at least of the same axial length dimension as ground penetration portion 32 including central portion 34. The bottom surface 110 of central portion 34 distributes the weight of the golf club across the surface of the ground covered by surface 110 and prevents the weight of the club from pressing the supporting device into soft ground. Tabular upper portion 36 is generally planar so that foot abutment surface 50 that extends generally perpendicular from side 88 of foot-press platform can act as a guide for the player's foot as it presses down against the foot-press platform.

Ground penetration portion 32, having axial length and axis of penetration denoted as 44, is designed to be inserted into ground surface 24 (as shown in FIGS. 3-7) to provide approximately vertical support for a desired golf club to support the grip of a golf club well above the ground surface. Central portion 34 is generally aligned with axis of penetration 44 of ground penetration portion 32. Central portion 34 has foot-press platform 46 for application of an insertion pressure by a player there against, or more precisely an insertion pressure supplied by a player's foot, which is not shown in any of the views, urging ground penetration portion 32 into ground surface 24. Foot-press platform 46 of central portion 34 has a center area 48 which in the embodiment shown is intersected by axis of penetration 44 of ground penetration portion 32. Ground penetration portion 32, as illustrated, is one example of how a penetration means may be constructed. Ground penetration portion 32, as shown, has four intersecting planar members 54, 56, 58, and 60 extending from foot contact portion 34 to a distal end 62 of ground penetration portion 32. It should be noted that in this example, the intersecting planar members were formed to be a seamless part of the golf club support device structure during the molding process. Each planar member 54, 56, 58, and 60 (seen best in FIG. 2) exhibit a plurality of decreasing in width tapers 64, 66, and 68 along axis of penetration 44.

Figure 3:
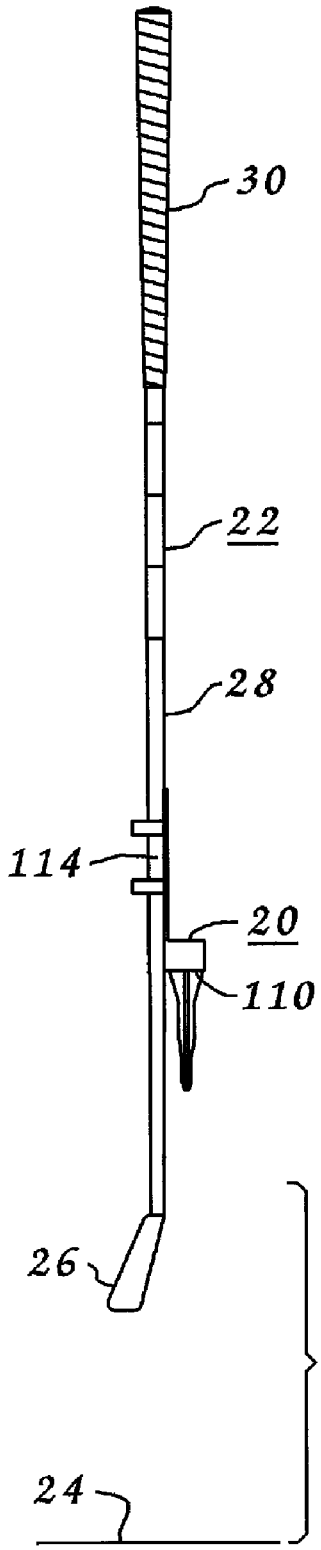
FIG. 3 is a side plan view of the golf club support device attached to a golf club and spaced from the head portion of the club with device and club elevated above the ground.

Still referring to FIGS. 3-7, golf club 22 including head portion 26, exposed shaft portion 28, and grip covered shaft portion 30, which hereinafter will be simply referred to as grip portion 30 is illustrated. Exposed shaft portion 28 is positioned between head portion 26 and grip portion 30. FIG. 3 further illustrates a first step of detachably attaching golf club support device 20 to any area of exposed shaft portion 28. Once golf club support device 20 is detachably attaching to an area of the exposed shaft portion it is slid down the entire length of the shaft, as illustrated FIG. 4 to position the support relative to the club so that the support is ready to be inserted into the ground by the insertion pressure of a golfer's foot. Ground insertion of golf club support device 20 preferably occurs with a golfer standing generally upright holding club shaft 28 or grip 30 of club 22 to place a foot, or alternatively an end of another golf club, on foot-press platform 46 and apply insertion pressure until the golf support device is securely emplaced below the ground surface.

Figure 6:
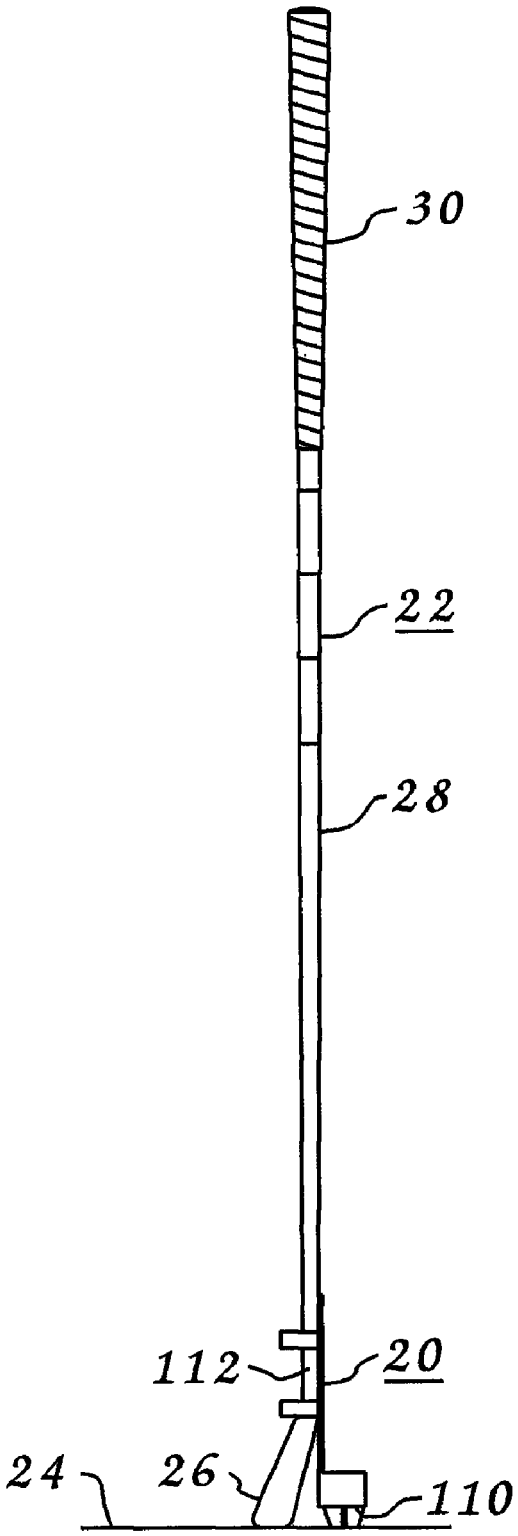
FIG. 6 is a side plan view of the golf club support device attached to a golf club following insertion of the device into the ground.
Figure 7:
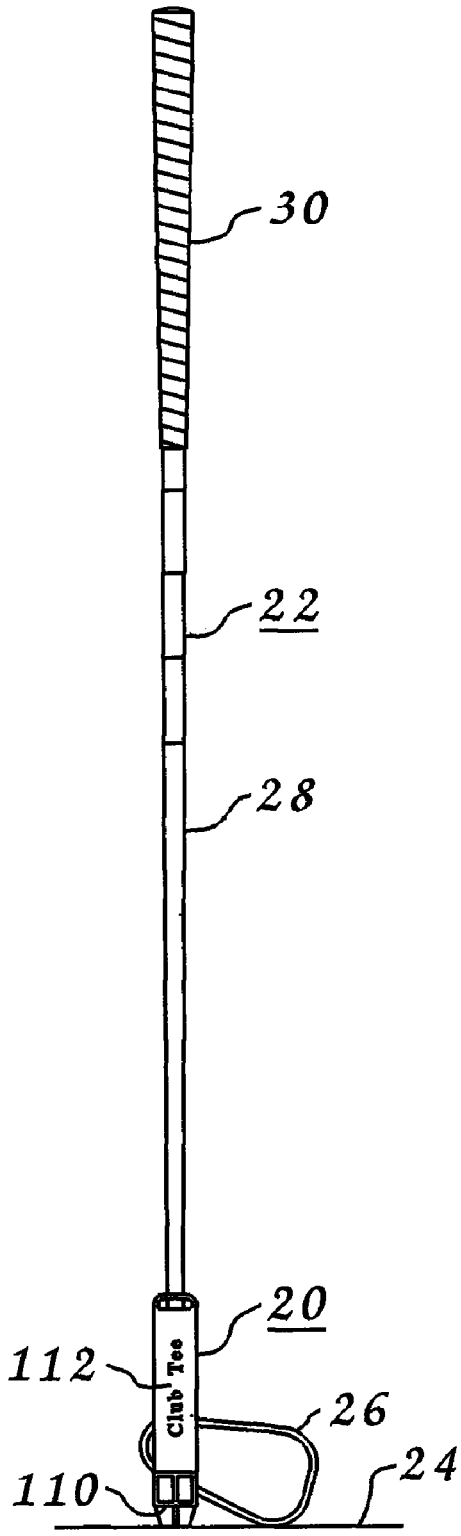
FIG. 7 is a front plan view of the depiction shown in FIG. 6.
Figure 8:
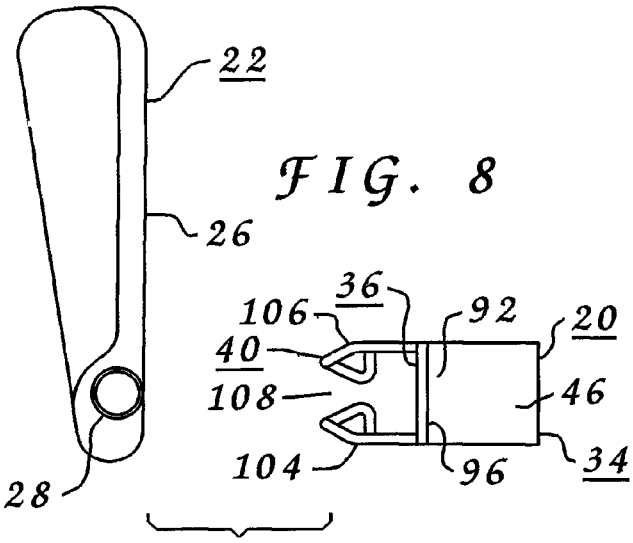
FIGS. 8-11 are top plan views of the golf club support device in various orientations during attachment of the device onto the shaft of a golf club and removal of the device from the shaft of a golf club.
Figure 9:
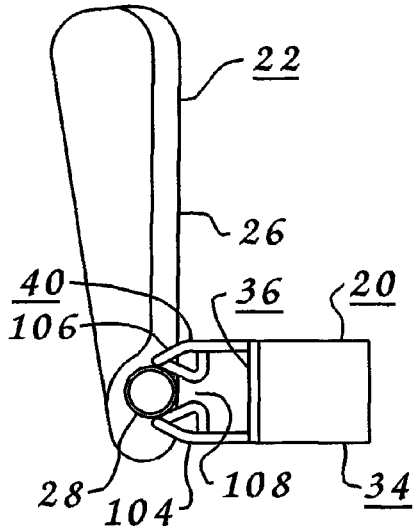
Figure 10:
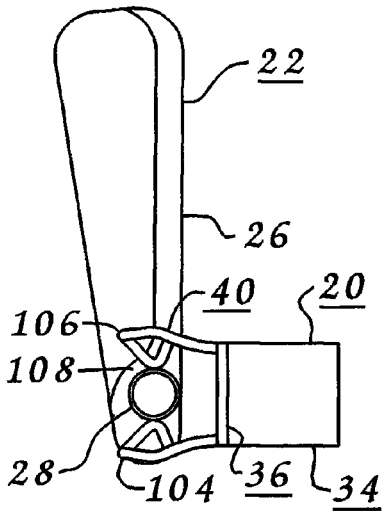
Figure 11:
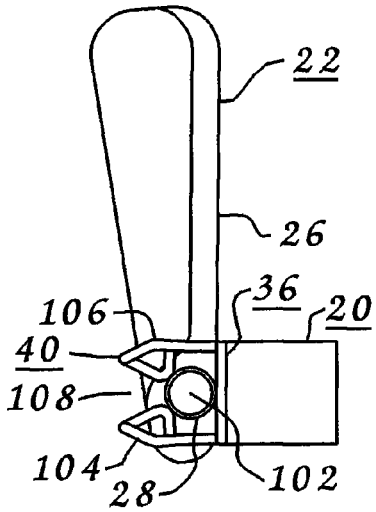

Once inserted into the ground, as illustrated in FIGS. 6 and 7, golf club support device 20 supports grip portion 30 well above ground surface 24, thus keeping the grip clean, dry, and readily available and the club visible so it will not be forgotten when the golfer moves on to the next shot. It should be noted that golf club support devices of the present invention will function with most existing golf club designs, including irons and putters.

In the embodiment illustrated, a golf club is held by spring-like clamps that were formed as a seamless part of the structure of golf club support device 20 during the molding process. As shown, the spring-like clamps extend outwardly from coupling surface side 52 that is opposite to foot abutment surface 50 side of tabular upper portion 36. In the embodiment illustrated, there are two engagement members, but it is within the contemplation of the invention that there could be only a single engagement member or more than two. In the present example, there is first shaft engagement member 38 and second shaft engagement member 40 that both extends outward from coupling surface side 52 of tabular upper portion 36. First shaft engagement member 38 securely engages exposed shaft portion 28 of golf club 22. Second shaft engagement member 40 securely engages another shaft portion 28 of golf club 22. First shaft engagement member 38 and second shaft engagement member 40 are aligned and spaced apart to cooperate during retention of exposed shaft portion 28 of golf club 22. It is an important feature of the invention that engagement members 38 and 40 are so positioned on the body of support 20 relative to the position of the foot-press platform to prevent a supported golf club from interfering with use of foot-press platform 48.

As illustrated in FIGS. 8-11, first and second shaft engagement members 38 and 40 may be structurally unique, although in the preferred embodiment illustrated, the first and second shaft engagement members 38 and 40 are generally identical. First and second shaft engagement members 38 and 40 cooperate to define an axis of securement 102 relative to exposed shaft portion 28 of golf club 22. Axis of securement 102 will vary depending upon various factors including the diameter of exposed shaft portion 28 of golf club 22 at the point of its attachment to support 20. Offset of structural placement of axis of securement 102 and of axis of penetration 44 of golf club support device 20 is an example of offset means.

Support 20 is said to approximate the size of a golf-tee. By this it is meant that the support device is sized to fit into the tee storage compartment for easy and convenient storage and transportation as golf club support device 20 may be easily and comfortably stored in most of the shaft insertion storage devices designed for storage of standard golf-tees, such as exists on many golf carts.

The compact size, light weight, and low-cost of device 20 lends itself to use as an incentive or thank-you gift or simply as a means of advertising. Side 89 of tabular upper portion 36 has an ample surface area for placement thereon of a display symbol 90. Display symbol 90 may be text, as depicted by 'Club Tee' which is the preferred name of golf club support device 20, and/or graphic representations typically associated with Trademarks or brand recognition logos.

Foot-press platform 46 has a width 92 along a line of contact 94 between central portion 34 and tabular upper portion 36. While a linear juncture is preferred at an intersection between foot-press platform 46 and tabular upper portion 36, a curved transition may be utilized, if desired. Tabular upper portion 36 has a width 96 along line of contact 94 between foot contact portion 34 and tabular upper portion 36. Preferably, width 92 and width 96 are a generally uniform width. Tabular upper portion 36 has a distal end 98 relative to central portion 34. Tabular upper portion 36 has aperture 100 penetrating tabular upper portion 36 generally at distal end 98 of tabular upper portion 36. Aperture 100 provides for attachment of a clip, not shown, where golf club support device 20 may be hung from another structure, such as a golf-bag, not shown, or a location on a golf cart, not shown, for storage.

As depicted, shaft portion 28 of golf club 22 being retained will be retained against tabular upper portion 36. Alternatively, it is possible to provide contact surfaces on first and second shaft engagement members 38 and 40 where shaft portion 28 of golf club 22 is retained in a spaced orientation from tabular upper portion 36. This arrangement provides for use with various golf clubs which have unique head shaft couplings where clearance problems may otherwise occur.

Figure 4:
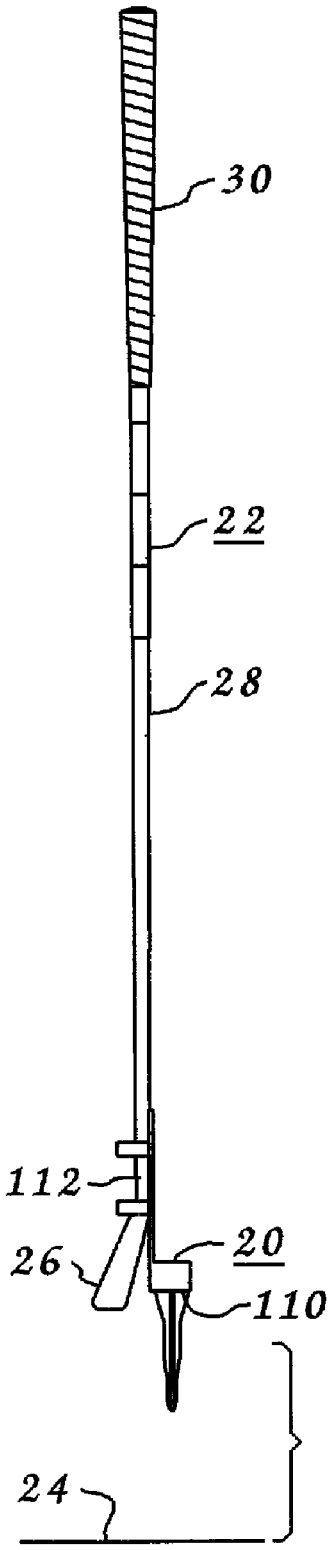
FIG. 4 is a side plan view of the depiction shown in FIG. 3 following a sliding displacement of the golf club support device along the golf club toward the ground with the assembly elevated above the ground.
Figure 5:
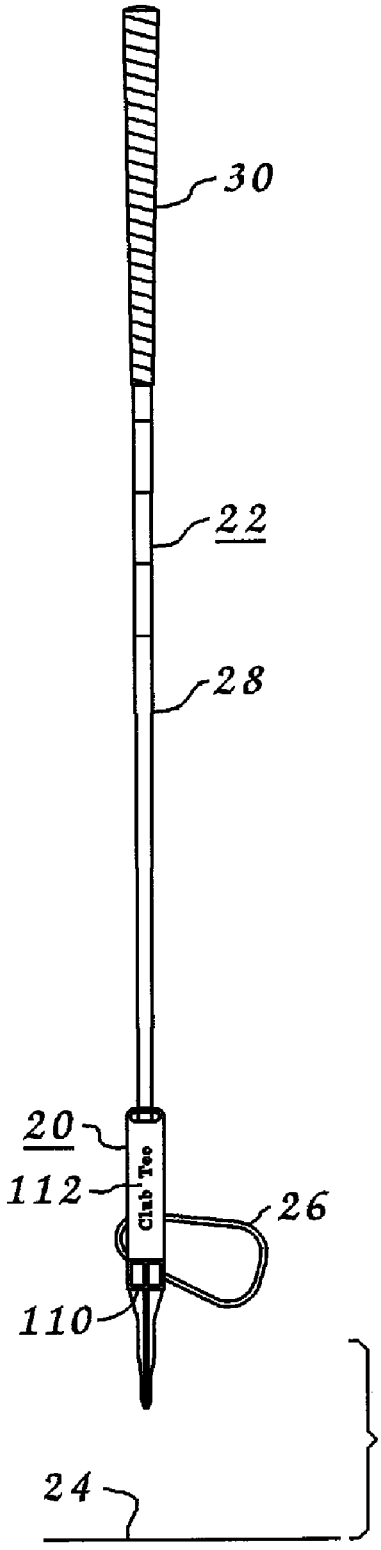
FIG. 5 is a front plan view of the depiction shown in FIG. 4.

Many of the conventionally known coupling arrangements may be utilized with the present invention for first and second shaft engagement members 38 and 40. It is a requirement, however, that such structural elements at least partially surround the exposed shaft portion of the golf club in close proximity to the head portion of the golf club. Preferably first and second shaft engagement members 38 and 40 are each of a pressure clip type having opposing flexible prongs 104 and 106 and a passageway 108 there between for insertion and removal of shaft portion 28 of golf club 22. Preferably, as illustrated in FIGS. 3-5, first and second shaft engagement members 38 and 40 are spaced on tabular upper portion 36 a sufficient spacing from a lowest extent 110 of central portion 34 to provide for ample room below first and second shaft engagement members 38 and 40 to accommodate head portion 26 of golf club 22 above ground 24 while ground penetration portion 32 is securely inserted into ground 24.

Support device 20 may be attached to exposed shaft portion 28 of golf club 22 directly at a final location 112 for attachment. Alternatively, placement and positional adjustment may occur if desired. FIG. 3 depicts attaching support device 20 to shaft portion 28 of golf club 22 at a location 114 spaced from head portion 26 of golf club 22. Following such attachment a sliding of support member 20 occurs where support device 20 is moved along shaft portion 28 of golf club 22 from location 114 spaced from head portion 26 of golf club 22 to location 112 on shaft portion 28 of golf club 22 in close proximity to head portion 26 of golf club 22. In this orientation, the device gripping the club is now ready to be inserted into the ground supporting the club in a nearly vertical position until the club is need for play, see FIGS. 4 and 5. When the club is needed for play, the player grasps the club and pulls it toward him. The club will stay attached to the support while the support is pulled from the ground. The player will then remove the support from the club shank and place it either in the tee holder, on the towel holder, or on the other club until the support is required, once more.

With respect to the above description then, it is to be realized that the optimum dimensional relationships for the parts of the invention, to include variations in size, material, shape, form, function and manner of operation, assembly and use, have been discussed above and are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The foregoing description, for purposes of explanation, uses specific and defined nomenclature to provide a thorough understanding of the invention. However, it will be apparent to one skilled in the art that the specific details are not required in order to practice the invention. Thus, the foregoing description of the specific embodiment is presented for purposes of illustration and description and is not intended to be exhaustive or to limit the invention to the precise form disclosed. Those skilled in the art will recognize that many changes may be made to the features, embodiments, and methods of making the embodiments of the invention described herein without departing from the spirit and scope of the invention. Furthermore, the present invention is not limited to the described methods, embodiments, features or combinations of features but include all the variation, methods, modifications, and combinations of features within the scope of the appended claims. The invention is limited only by the claims.

What is claimed is:

1. A golf club support device, comprising:

an upper portion having a first and second side, an intermediate flange portion extending only from said first side at substantially a right-angle thereto, said flange portion having a foot-press upper surface and a lower surface, at least one clamp extending from said second side of said upper portion, said clamp spaced from said intermediate portion, wherein said at least one clamp is able to clamp on a golf club shaft, and a spiked lower portion extending from said lower surface at substantially a right-angle thereto and generally parallel to said upper portion.

2. The device, as recited in claim 1, wherein said upper portion, said intermediate flange portion, said at least one clamp, and said spiked lower portion together comprise a seamless all-in-one structure.

3. The device, as recited in claim 1, wherein said upper portion, said intermediate flange portion, said at least one clamp, and said spiked lower portion structured further comprise a molded seamless all-in-one structure.

4. The device, as recited in claim 1, having all fixed parts.

5. The device, as recited in claim 1, further comprising wherein said at least one clamp is a resilient clamp.

6. The device, as recited in claim 1, further comprising wherein said at least one clamp is two clamps.

7. The device, as recited in claim 1, wherein said upper portion further comprises an aperture.

8. The device, as recited in claim 1, wherein said upper portion further comprises an area on said first side and/or said second side containing graphics.

9. A golf club support device, comprising:

an upper portion having a first and second side, an intermediate flange portion extending only from said first side at substantially a right-angle thereto, said flange portion having a foot-press upper surface and a lower surface, at least one clamp extending from said second side of said upper portion, said clamp spaced a distance relative to said intermediate portion, wherein said at least one clamp is able to clamp on a golf club shaft, and a spiked lower portion extending from said lower surface generally parallel to said upper portion.

10. The device, as recited in claim 9, wherein said upper portion, said intermediate flange portion, said at least one clamp, and said spiked lower portion together comprise a seamless all-in-one structure.

11. The device, as recited in claim 9, wherein said upper portion, said intermediate flange portion, said at least one clamp, and said spiked lower portion structured further comprise a molded seamless all-in-one structure.

12. The device, as recited in claim 9, having all fixed parts.

13. The device, as recited in claim 9, wherein said upper portion further comprises an area on said first side and/or said second side containing graphics.

14. A golf club support device for supporting a golf club without requiring bending or stooping of the user comprising:

said support device molded as a seamless one-piece structure having all fixed parts, a lower portion having a central flange portion and a stake-like portion, an upper portion having a first side and a second side and an axis of elongation, said central flange portion extending only at a substantially right-angle from said first side of said upper portion, said central flange portion having a foot-press platform upper surface that is maintained relatively horizontal to ground surface when the device is inserted in the ground and a lower surface, said stake-like portion for ground penetration extending from said lower surface at substantially a right-angle thereto in axial offset alignment from said upper portion, said upper portion having at least a first shaft engagement member extending from said second side for securely engaging a shaft portion of a golf club providing for the long axis of the golf club to be supported relatively vertical when the device is inserted in the ground, said lower portion having a longitudinal length that approximates the longitudinal length of the upper portion, and said upper portion comprising an area on said first side and/or said second side containing graphics.

* * * * *